United States Patent [19]

Say

[11] 3,962,599

[45] June 8, 1976

[54] SHIELDING MEANS FOR CATHODE RAY TUBE

[75] Inventor: Donald L. Say, Waterloo, N.Y.

[73] Assignee: GTE Sylvania Incorporated, Stamford, Conn.

[22] Filed: Nov. 25, 1974

[21] Appl. No.: 526,720

[52] U.S. Cl. ..... 313/449; 313/414
[51] Int. Cl.[2] ..... H01J 29/02; H01J 29/56
[58] Field of Search ..... 313/414, 412, 409, 417, 313/449

[56] References Cited

UNITED STATES PATENTS

| | | | |
|---|---|---|---|
| 3,376,448 | 4/1968 | Schwartz | 313/414 |
| 3,389,284 | 6/1968 | Andrews | 313/417 |
| 3,558,954 | 1/1971 | Lilley | 313/414 |
| 3,564,327 | 2/1971 | Johnson | 313/412 X |
| 3,619,688 | 11/1971 | McQueen et al. | 313/292 X |

*Primary Examiner*—Robert Segal
*Attorney, Agent, or Firm*—Norman J. O'Malley; Frederick H. Rinn; Robert T. Orner

[57] ABSTRACT

An internal improvement is provided in a cathode ray tube wherein the electron gun assembly is positioned in close proximity to the sidewall of the encompassing neck portion of the tube envelope. The improvement is in the form of discrete shielding means incorporated in conjunction with one or more electrodes in the forward portion of a multi-beam electron gun assembly to minimize the effect of positive neck charge on the trajectories of the electron beams traversing the portions of the assembly closely related to the neck wall. Each shielding means is comprised of an element formed of substantially round wire material configurated as a U-shaped member, whereof the bottom bridge-portion of the member is substantially contiguous with the rolled rim of the associated electrode, extending outward therefrom toward but not touching the adjacent glass wall of the neck. The shielding, so positioned, dimensionally reduces the areal region through which the effects of the neck charge may influence the beam traversing the related electrodes.

10 Claims, 6 Drawing Figures

SHIELDING MEANS FOR CATHODE RAY TUBE

BACKGROUND OF THE INVENTION

This invention relates to an improvement in the internal structure of a cathode ray tube and more particularly to improved shielding means for minimizing the effects of neck charge on the beam trajectory within the electron gun assembly of the tube.

The advance of cathode ray tube technology has introduced a trend toward miniaturization and compaction of electron gun structures, such structures in turn being encompassed within envelope neck portions of smaller diametrical dimensions. Consequently, the spacings between the electrode components of the electron gun assembly and the adjacent sidewall of the enclosing neck portion of the envelope have of necessity become increasingly smaller. This constructional condition is a consideration of prime importance in multi-beam color cathode ray tubes, especially in the types employing in-line electron gun construction wherein the side-oriented electrodes in the gun assembly are particularly close to the wall of the neck.

The presence of an electrical charge on the interior surface of the envelope neck portion, particularly in the region encompassing the electron gun assembly, is a known and elusive phenomenon associated with both the processing and operation of the tube. While all aspects of the neck charge condition are not fully understood, it appears to be influenced by the presence of minute sublimations deposited on the interior surface of the glass during stages of tube processing and subsequent operation. While glass per se will retain an electrical charge, the additional presence of a minute film of sublimated contaminants thereover tends it aggravate the neck charging condition.

In cathode ray tube construction it is usual practice for the funnel-disposed conductive coating to extend into the forward region of the contiguously integrated neck portion. Normally, this coating is of the same high positive electrical potential as that of the final electrode of the electron gun assembly. The adjacency of this high potential conductive coating which ends in the forward region of the neck portion, in conjunction with the possible presence of contamination on the glass surrounding the forward portion of the electron gun assembly, creates a condition fostering the build-up of a positive electrical charge on the interior surface of the glass in that region of the neck.

In the forward portion of the electron gun assembly, the inter-electrode spacing between the focusing and high voltage accelerating electrodes is a vulnerable region through which the neck charge may influence the trajectory of the electron beam traversing the respective electrodes. For example, in an in-line gun color cathode ray tube, the proximal presence of the positive neck charge influence gradually causes the outer beams to move slightly outward from their normal paths. This change in beam positioning is noticeable as a gradual deterioration of the color imagery on the screen display wherein the edge definitions of the constituents of the display become gradually multi-colored and lose sharpness due to misplacement of focused beam impingement on the phosphor elements of the screen. This condition, which is referenced as static convergence drift, may develop to a degree necessitating readjustment of the exteriorly positioned beam correction devices or the operational circuitry related thereto. To minimize this condition, a known practice in the art has been to employ a substantially step-shaped metallic shield formed substantially of flat metallic material. This type of shielding was usually attached to the high voltage accelerating electrode in a manner to extend outward and slightly rearward therefrom to effect partial shielding of the interelectrode spacing between the focusing and accelerating electrodes. Such shielding, being positioned slightly outward from the electrodes, required a substantial amount of lateral spacing which is not available in many of the present tube constructions. In addition, this flat-type of drift shield, being formed substantially of sheet material, was prone to evidence an existence of sharp projections which were conducive for the possible generation of deleterious arcing within the gun structure.

OBJECT AND SUMMARY OF THE INVENTION

It is an object of this invention to reduce an obviate the aforementioned disadvantages that have been evidenced in prior art cathode ray tubes. Another object of the invention is to provide improved internal shielding means for discrete portions of a cathode ray tube electron gun structure. A further object is to provide an improved means for minimizing the static convergence drift within a color cathode ray tube.

These and other objects and advantages are achieved in one aspect of the invention wherein an improvement in a cathode ray tube is in the form of advantageous shielding means incorporated in the forward portion of the electron gun assembly. For example, in a multi-beam color tube, the interrelated focusing and high voltage accelerating electrodes, included in the forward region of the gun assembly, have spatially related portions formed as outwardly rolled rims to provide substantially rounded adjacently related surfaces. The improved shielding means of the invention, which minimizes the effect of the positive neck charge on the trajectory of the related electron beam, is comprised of an element formed of substantially round wire material which is configurated as a substantially U-shaped member. The legs of this shielding means are attached to at least one of the aforementioned electrodes in a manner whereof the bottom bridge-portion of the U-shaped member is substantially contiguous with the rolled rim of the electrode extending outward therefrom toward but not touching the adjacent glass wall of the encompassing neck portion. The shielding improvement so positioned dimensionally reduces the region through which the influences of the electrical charge on the neck portion may penetrate into the adjacent gun structure.

DESCRIPTION OF THE PREFERRED EMBODIMENT

For a better understanding of the present invention, together with other and further objects, advantages and capabilities thereof, reference is made to the following specification and appended claims in connection with the aforedescribed drawings.

While the invention is applicable to utilization in any type of cathode ray tube wherein the electrode components of the gun assembly are closely adjacent to the side wall of the neck portion, for purposes of illustration, a color cathode ray tube employing an apertured shadow mask and an in-line plural gun electron generating assembly will be described in this specification.

Figure 1:
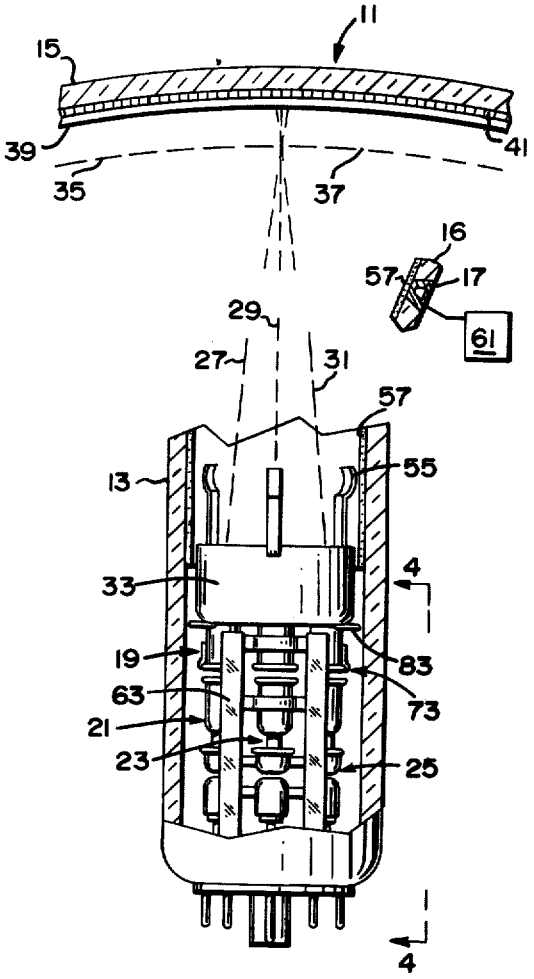
FIG. 1 is a partial plan view showing primarily the neck and screen portions of a plural gun color cathode ray tube embodying the invention.

With particular reference to FIG. 1, describing one embodiment of the invention, there are shown pertinent portions of a typical three-gun in-line color cathode ray tube 11 as employed in producing visual displays such as television and allied applications. The neck portion 13 of the tube envelope is suitably connected to the oppositely disposed face panel portion 15 by an intermediate funnel portion 16 of which only the high voltage connection area 17 is shown. Within the neck portion 13 is positioned a multi-beam electron gun assembly 19 having, in this instance, three individual gun structures 21, 23, and 25. Each of these individual electron guns generates, forms and focuses a discrete beam of controlled electrons, respectively indicated as 27, 29, 31, each of which traverses the magnetic convergence structure 33 terminally positioned on the electron gun assembly 19. This convergence assembly imparts positional corrections to the several beams as are necessary for directing them in optimum paths to achieve convergence at the plane of the aperture mask 35. By this convergence the individual beams are positioned to pass through the apertures 37 therein; whereupon they penetrate the usually present reflective aluminum film 39 therebeneath, and thence impinge and excite the proper discrete patterns of the cathodoluminescent screen 41 disposed on the interior surface of the face panel 15.

Figure 2:
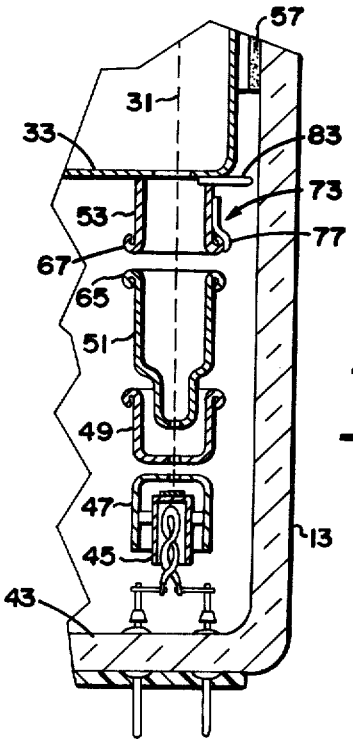
FIG. 2 is an enlarged sectional view of a portion of FIG. 1 showing for example details of the right hand electron gun of the gun assembly.

In greater detail and with particular reference to both FIGS. 1 and 2, each of the individual electron guns of the multi-beam electron gun assembly is, for example, of the bi-potential variety made up of a longitudinal arrangement of sequentially related electrodes. In delineating the structure, reference is directed to one of the side oriented guns 25 wherein starting with the base or closure end 43 of the tube, the first electrode adjacent thereto is a cathode assembly structure 45 containing an indirectly heated cathode which generates electrons. Sequentially positioned therefrom is a control grid electrode 47 which forms or modulates the electrons into a beam 31, whereupon it is initially accelerated by the influences of a second grid electrode 49. A third grid electrode 51 provides focusing, and the fourth or high voltage terminal grid electrode 53 imparts final velocity or acceleration to the beam 31. Usually, electrical connections are made to all of the electrodes, except the terminal or fourth grid electrode, by a plurality of connectors, not shown, which are hermetically sealed into and traverse the closure base 43 of the tube. In the case of the high voltage acceleration electrode 53, electrical connection is made through a plurality of resilient snubbers 55 which are peripherally affixed to the terminal magnetic convergence assembly 33. These snubbers make electrical connection to the internal conductive coating 57 lining the upper part of the neck portion 13 and extending therefrom over the interior surface of the funnel portion 16, of which only a small area is shown. A high voltage connective means 17 is hermetically sealed in the aforementioned funnel portion to connect the internal conductive coating 57 to an external high voltage source 61. The respective electrode arrangements of the individual guns 21, 23, and 25, making up the electron gun assembly, are affixed to and supported by a plurality of insulative glass support rods 63, of which two are shown.

Since the electrical potential applied to the high voltage accelerating electrode 53 is, for example, usually in the order of 25 KV or greater, and the potential of the adjacent focusing electrode 51 is in the order of at least 4.5 KV, the voltage gradient therebetween is of sufficient magnitude to foster arcing if sharp or pointed inter-electrode projections from either electrode are present. Therefore, to inhibit arcing between the focusing and accelerating electrodes, the spatially related portions of the respective members are formed as outwardly rolled rims 65 and 67 to provide rounded adjacently related surfaces substantially free of any arc inducing projections. Such rolled rims are often referred to in the art as corona rings.

Figure 3:
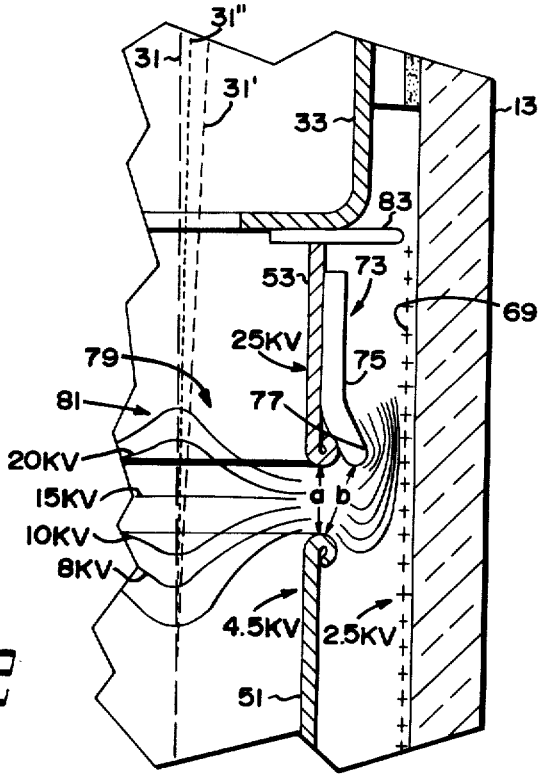
FIG. 3 is a further enlargement of a partial section of FIG. 2 delineating the forward portion of one of the electron guns.
Figure 4:
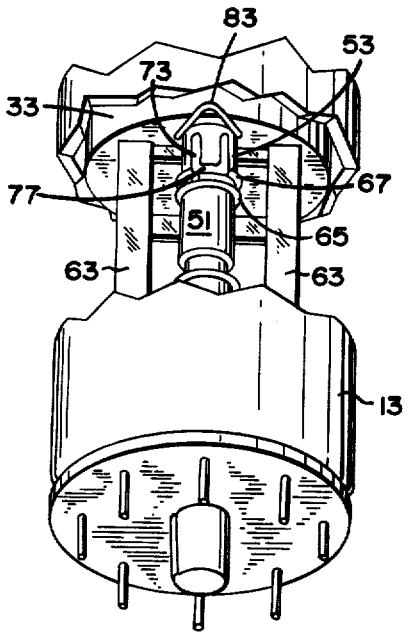
FIG. 4 is a perspective relating to FIG. 1 taken substantially along the line 4—4 thereof and illustrating the configuration and orientation of the invention.

Further reference is directed to FIG. 3 which is an enlargement of a portion of the forward region of the electron gun structure illustrated in FIG. 2. The positive electrical charge 69 formed on the interior surface of the glass neck 13 of the tube is indicated (+) in the vicinity of the focusing 51 and high voltage accelerating 53 electrodes. In an absence of shielding of the inter-electrode spacing between the focusing and accelerating electrodes, the positive charge 69 is permitted to influence the trajectory of the electron beam 31. Such influencing causes a slight outward movement 31' of the beam from its normal path. The invention minimizes this effect and comprises improved shielding means 73, which in this instance, is associated with the high voltage accelerating electrode 53, as shown in FIGS. 3 and 4. This improved shielding element 73 is formed of round wire non-magnetic material which is configurated as a substantially U-shaped member. While stainless steel is an exemplary metal, any non-magnetic conducting material that is compatible with the internal environment of the tube is applicable for fabrication of the shielding member 73. The legs 75 of this member are affixed as by bonding to the side of the substantially cylindrical accelerating electrode 53 in a manner whereof the bottom bridge-portion 77 of the U-shaped member is substantially contiguous with the rolled corona rim 67 of the electrode 53, substantially following the peripheral contour thereof and extending outward therefrom toward but not touching the adjacent glass wall of the neck portion 13. While not shown, the length of the bridging portion 77 may be fabricated to extend as much as half way around the periphery of the rolled rim of the electrode to provide increased shielding effect. Since the bridge portion of the shield is in a region of high potential gradient, contact of the extending bridge-portion 77 with the glass neck may cause electrolysis of the glass thereby inducing localized weakening of the wall. Therefore, the factor of lateral spacing is important. As an example of suitable lateral spacing, when the lateral distance between the corona ring 67 and the interior surface of the neck 13 is in the order of 0.050 of an inch, the diameter of the wire shielding material may be of a nominal value such as 0.030 of an inch, thereby providing a spatial relationship of approximately 0.020 of an inch between the shield and the glass. In order to maintain the proper inter-electrode spacing *a*, the distance *b* between the bottom bridge 77 of the U-shaped shielding member and the rolled rim 65 of the sequentially related focusing electrode 51 should be of a dimension not less than the inter-electrode spacing *a*.

What is thought to be the functioning of the shielding member is delineated in FIG. 3. As exemplarily shown, the 25 KV potential applied to the high voltage accelerating electrode 53 in conjunction with the 4.5 KV potential on the focusing electrode 51, provides a lensing field 79 which focuses the beam 31 to a small spot size on the screen 41. What are considered to be representative equipotential lines of force 81 are severally shown as extending in the spacing between the accelerating electrode 53 and the wall of the neck 13. The positive charge 69 on the neck which varies with time and from tube to tube may be, for example, in the order of 2.5 KV, thereby exerting a degree of distortion on the adjacent equipotential lines of the lensing field 79. This distortion extends into the lensing proper within the electrodes which tends to move the beam 31 slightly outward from its intended path. Since the presence of a shielding member 73 decreases the spacing and thereby compresses the equipotential lines of force in that region, the distorting effect of the neck charge 69 on the lensing is lessened because of the closer proximity of the higher potential lines of force of the lensing field which are least affected by the neck charge. Thus, the lensing field is less subject to change and better approaches the desired shaping thereby directing the beam 31 closer to the intended trajectory, as indicated at 31'', within the related electrodes.

Figure 5:
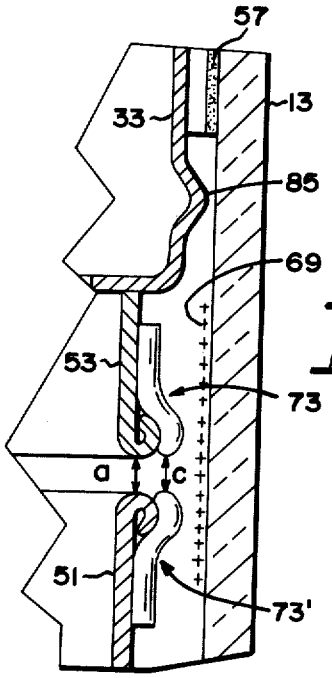
FIG. 5 is a partial sectional of a forward portion of the gun structure and related wall of the neck portion showing a further embodiment of the invention.

While not as effective, a U-shaped shielding member 73' may also be attached to the lower potential focusing electrode 51. If desired, augmented shielding can be achieved by employing U-shaped shielding members 73 and 73' as separate attachments to both the focusing 51 and high voltage accelerating 53 electrodes as shown in FIG. 5. The spacing *c* between the respective bridge-portions of the two related U-shaped shielding members 73 and 73' should not be less than the inter-electrode spacing *a* between the related focusing and accelerating electrodes.

With reference to the Figures, it has been found beneficial to utilize a plurality of lateral spacer means 83 which are integrated to the forward region of the electron gun assembly 19 in a peripheral spaced apart manner to extend outward therefrom toward the encompassing wall of the neck 13 to facilitate slidable-insertion of the gun assembly into the tubular neck. While the previously mentioned resilient contact snubbers 55 perform a centering function, it has been found that they do not promote the desired degree of precise centering necessary for optimum functioning of the shielding means 73 of the invention. The lateral spacer means of the invention provide substantially positive centering of the electron gun assembly 19 within the neck portion thereby effecting the desired substantially equal spacing between the shielding members and the interior wall of the neck portion. The embodiment of the lateral spacing means 83 illustrated in FIGS. 1, 2, and 3 is further delineated in a perspective shown in FIG. 4. Spacer means of this type are substantially V-shaped members formed of round wire material which are affixed to the exterior surface of the bottom of the convergence cage structure 33 positionally attached to the terminal ends of the high voltage accelerating electrodes. These substantially V-shaped spacers are oriented to extend outward from the periphery of the convergence cage toward the wall of the neck portion. At least two of these spacer means are employed in an in-line electron gun assembly.

Another embodiment of the lateral spacer means is shown in FIG. 5 wherein a plurality of outstanding dimple-like protuberances 85 are formed in the wall of the convergence cage structure 33 in a manner to extend toward the interior surface of the neck portion 13.

Figure 6:
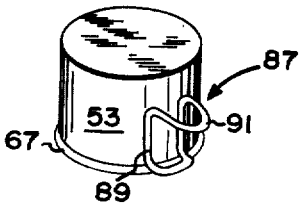
FIG. 6 is a limited perspective illustrating another embodiment of the invention as employed in conjunction with an accelerating electrode.

A combination embodiment 87 of the spacer and shielding means is shown in FIG. 6, wherein it is delineated as being positioned and attached to the high voltage accelerating electrode 53, the other components of the electron gun assembly are not shown. In this combination structure, the U-shaped portion 89 of the member is formed of a single piece of substantially round wire which is further configurated to incorporate an outstanding portion 91 thereof, removed from the bridge-portion of the U-shaping, to provide the lateral spacing means for effecting substantial centering of the electron gun assembly 19 within the neck portion.

Thus, there is provided an improved internal shielding means for discrete portions of a cathode ray tube electron gun structure which expeditiously minimizes the static convergence drift of electron beams within a color cathode ray tube. The invention is particularly advantageous in multi-beam tube construction wherein portions of the electron gun structure are positioned in close proximity to the side wall of the encompassing neck portion of the envelope. The shielding means and the lateral spacing means associated therewith, can be expeditiously incorporated into the tube structure during tube fabrication.

While there has been shown and described what are at present considered the preferred embodiments of the invention, it will be obvious to those skilled in the art that various changes and modifications may be made therein without departing from the scope of the invention as defined by the appended claims.

What is claimed is:

1. An improvement in a cathode ray tube having an envelope with a cathodoluminescent screen formed on the viewing panel portion, a conductive coating interiorly disposed on the funnel and the upper neck portions, and a related multi-electrode electron gun assembly positioned in the glass neck portion in a manner to beam electrons to said screen, said gun assembly including in the forward region thereof neck contacting snubber means, a focusing electrode and a forwardly positioned high voltage accelerating electrode, said sequentially related electrodes having spatially related portions formed as outwardly rolled rims to provide rounded adjacently related surfaces, said improvement being shielding means comprising:

an element formed of round wire material configurated as a substantially U-shaped member having a bottom bridge and a pair of extending legs, the legs of said member being both attached to the side of at least one of said electrodes in a manner whereof the bottom bridge portion of said U-shaped member is fabricated to partially follow the peripheral contour of and be substantially contiguous with the rolled rim of said electrode extending outward therefrom toward but not touching the adjacent glass wall of said neck portion.

2. The improved shielding means according to claim 1 wherein the spacing between the bottom bridge of said U-shaped shielding member and the rolled rim of said sequentially related electrode is of a dimension not less than the inter-electrode spacing between said related electrodes.

3. The improved shielding means according to claim 1 wherein said U-shaped shielding member is attached to said high voltage accelerating electrode.

4. The improved shielding means according to claim 1 wherein said U-shaped shielding member is attached to said focusing electrode.

5. The improved shielding means according to claim 1 wherein U-shaped shielding members are separately attached to both the focusing and high voltage accelerating electrodes, and wherein the spacing between the respective bridge portions of said U-shaped shielding members is not less than the inter-electrode spacing between said related electrodes.

6. The improved shielding means according to claim 1 wherein a plurality of auxiliary lateral spacer means are integrated to the forward region of said electron gun assembly in a spaced apart manner to extend outward therefrom to provide positive centering of said electron gun assembly in said neck portion and effect substantially equal spacing between said shielding members and the interior wall of said neck portion.

7. The improved shielding means according to claim 6 wherein said lateral spacing means are affixed to a convergence cage structure attached to the terminal end of said high voltage accelerating electrode.

8. The improved shielding means according to claim 7 wherein said lateral spacer means are substantially V-shaped wire formed members attached to the exterior surface of the bottom of said convergence cage in a manner to extend outward therefrom towards said neck portion.

9. The improved shielding means according to claim 6 wherein said lateral spacing means are outstanding dimple-like protuberances formed in the wall of a convergence cage structure attached to the terminal end of said high voltage accelerating electrode.

10. The improved shielding means according to claim 1 wherein said U-shaped member is formed of a single piece of wire configurated to incorporate an outstanding portion thereof removed from the bridge portion of said U-shaping to provide a lateral spacing means to effect substantial centering of said electron gun assembly in said neck portion.

* * * * *